US005395725A

United States Patent [19]

Bluett et al.

[11] Patent Number: 5,395,725

[45] Date of Patent: Mar. 7, 1995

[54] FUSER OIL COMPOSITIONS AND PROCESSES THEREOF

[75] Inventors: Lynn J. Bluett, Rochester; Haig C. Donoian; Fred A. Elder, both of Webster, all of N.Y.

[73] Assignee: Xerox Corporation, Stamford, Conn.

[21] Appl. No.: 155,269

[22] Filed: Nov. 22, 1993

[51] Int. Cl.[6] ..... G03G 13/20

[52] U.S. Cl. ..... 430/124

[58] Field of Search ..... 430/109, 124, 99

[56] References Cited

U.S. PATENT DOCUMENTS 4,029,827 6/1977 Imperial et al. ..... 427/22

4,251,277 2/1981 Martin ..... 106/38.22

4,515,884 5/1985 Field et al. ..... 430/99

5,217,837 6/1993 Henry et al. ..... 430/124

5,281,506 1/1994 Badesha et al. ..... 430/124

*Primary Examiner*—John Goodrow

*Attorney, Agent, or Firm*—John L. Haack

[57] ABSTRACT

A process for fusing toner images to a substrate comprising: providing a fusing member having a fusing surface; heating said fuser member to an elevated temperature to fuse toner to said substrate; applying directly to said fusing surface a fuser release agent oil blend composition wherein volatile emissions arising from the fuser release agent oil blend are minimized or eliminated.

24 Claims, 1 Drawing Sheet

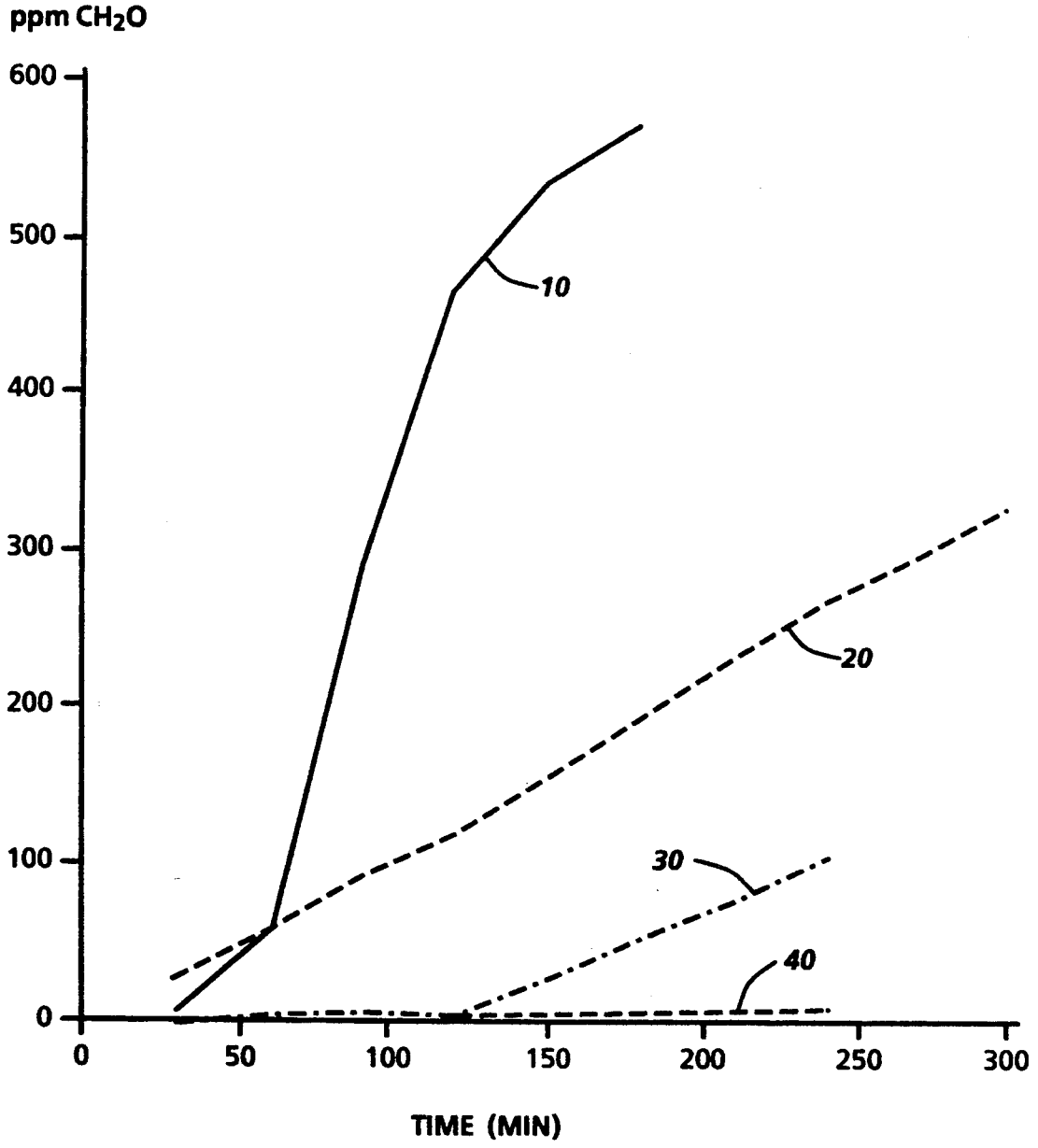
ppm $CH_2O$
600
500
400
300
200
100
0
10
20
30
40
0
50
100
150
200
250
300
TIME (MIN)

FUSER OIL COMPOSITIONS AND PROCESSES THEREOF

CROSS REFERENCE TO COPENDING APPLICATIONS AND RELATED PATENTS

Attention is directed to U.S. Pat. Nos. 4,029,827 (D/73513) entitled "Mercapto Functional Polyorganosiloxane Release Agents for Fusers in Electrostatic Copiers", 4,515,884 (D/81033) entitled "Fusing System with Unblended Silicone Oil", and 5,217,837 (D/91367) entitled "Multilayered Fuser Member".

Attention is also directed to copending application U.S. Ser. No. 08/098,088, filed Jul. 28, 1993 (D/93112) entitled "Fuser Member".

BACKGROUND OF THE INVENTION

The present invention relates to fuser oil compositions, fusing of developed xerographic images and more particularly to compositions and processes which are effective in minimizing or eliminating volatile emissions from the heated fuser oil composition during thermal and or pressure fusing operations. The compositions which are particularly effective as volatile emission inhibitors or suppressants and as release agents for a variety of metal, elastomeric, or composite fuser substrates contain blends comprised of: an amino functional, a trifluoro functional, or nonfunctional organopolysiloxane; and a mercapto functional polysiloxane having at least one mercaptan group.

Various compositions have been proposed for treating fuser roll and belt substrates to impart release properties thereto. However, many of these compositions, in particular those comprised of organopolysiloxanes and various derivatives thereof, suffer from thermal instability when heated to fusing temperatures, for example about 150° C. and above for short periods of time of, for example, about 0.5 seconds and longer. Thermal degradation of organopolysiloxane release agents, such as dimethylsilicone oils and related derivatives may result in the generation of volatile byproducts, for example, formaldehyde ($CH_2{=}O$), formic acid ($HCO_2H$), carbon dioxide ($CO_2$), carbon monoxide (CO), hydrogen ($H_2$), methanol ($CH_3OH$), ammonia ($NH_3$), hydrogen sulfide ($H_2S$), trifluoropropionaldehyde ($CF_3CH_2CH{=}O$), and the like, which byproducts are potentially objectionable odor and mucousal irritants in the ambient environment of an operating xerographic machine. The byproducts may also be harmful to machine components and subsystems, such as photoreceptor belts or fuser rolls, promoting premature failure. Further, the byproducts may remain dissolved in the release agent oil and may promote continued or accelerated degradation of the silicone release agent oil composition thereby leading to undesirable changes in release agent viscosity, release properties, and perhaps negatively impacting optimal fusing performance of the fusing subsystem. The volatile emissions also have an unpleasant odor and are potentially hazardous to machine operators or passersby, particularly with prolonged exposure. Volatile emissions from fused copy or prints, that is volatiles that are dissolved in the release agent oil, may become imbibed into paper fibers, synthetic receiver sheet materials, or fixed toner images, and may outgas over time and may further pose an objectionable odor or irritation problem which may lead to reduced customer acceptance and satisfaction.

Other sources of volatile emission components include residuals from preparative reactions or purification processes residing in the oil itself, such as solvents, monomers, initiators, impurities, and the like; and degradation products arising from various oil performance additives. Commercial manufacturers and suppliers of silicone release agent oil products routinely employ additional processing steps to purposely "devolatilize" their products in recognition of volatile emissions being a problem for corrosion or contamination of mechanical and electrical machine components.

Antioxidant additives for silicone fluids are known. J. M. Nielsen in "Stabilization of Polymers and Stabilizer Processes", *Advances in Chemistry Series*, Vol. 85, American Chemical Society, Washington D.C., 1968, provides an early account of antioxidant additives for silicone fluids including, for example, redox metal complexes and soaps which are however disadvantaged by producing haze, gels or sludge on storage and or during use, and interfering with copy quality and color print fidelity.

T. S. Heu in *Journal of the Korean Rubber Society*, Vol. 18, No. 1, pages 21 to 29 (1983) describes the stability and degradation prevention of silicone oils and rubbers. Silicone compound stability is categorized into oxidation stability and thermal stability. Oxidation stability refers to resistance of the silicone compound to react with oxygen which reactions lead to intermolecular cross-linking and increased viscosity for silicone liquids and hardening for silicone rubbers. Thermal stability refers to the resistance of the silicone compound to undergo intramolecular cleavage of siloxane bonds (Si—O—Si) by heat which reactions produce lower molecular weight products and leads to reduced viscosity for silicone oils and softening of silicone rubbers. Resistance to both pathways of degradation is called thermal oxidation stability. Homologous hydrocarbon structural derivatives of dimethyl polysiloxanes such as ethyl, propyl, butyl, and the like, generally possess lower thermal stability than the dimethyl compound. Certain structural derivatives of polysiloxanes have enhanced thermal stability, for example, phenyl methyl siloxane, but these derivatives are disadvantaged by their higher cost and thermal degradation liberates benzene. Thermal stability for silicone oils having the same repeat unit is generally higher for the oil with the greater molecular weight.

Additives made from, for example, salts of organometallic acids are commonly used to improve the thermal oxidation stability of silicone oils. However, these salts chemically react with the silicone oil in a multitude of ways as part of the stabilization mechanism and therefore unpredictably lead to oils having significantly altered physical, for example, viscosity and performance, for example, release properties.

The following United States Patents are of interest:

U.S. Pat. No. 4,029,827, to Imperial et al, issued Jun. 14, 1977, discloses polyorganosiloxanes having functional mercapto groups, are applied to a heated fuser member in an electrostatic reproducing apparatus to form thereon a thermally stable, renewable, self-cleaning layer having superior toner release properties for electroscopic thermoplastic resin toners.

U.S. Pat. No. 4,251,277, to Martin, issued Feb. 17, 1981, discloses compositions containing organopolysiloxanes and thiofunctional polysiloxanes having at least one mercaptan group which are effective as corrosion inhibitors and as release agents for metal substrates.

U.S. Pat. No. 4,515,884 to Field et al, issued May 7, 1985, discloses a method of fusing by providing a silicone elastomer fusing surface, heating the fuser member to fuse toner particles to the receiver substrate, applying directly to the silicone elastomer fusing surface in non-emulsified form an unblended polydimethylsiloxane having a viscosity of about 7,000 to about 20,000 centistokes, and contacting the toner image on the substrate with the toner release agent which includes an unblended polydimethyl siloxane In xerographic applications, it is desirable to use release agent oils which are: cost effective; clear; colorless; odorless or nearly so at room temperature and at fuser operating temperatures; free of additives such as acids, bases, peroxides, heavy metals, and the like, that can interfere with the fusing and sheet release performance of the fusing system and associated hardware; and free of or produce minimal volatile emission component(s) over the service life of the release agent oil.

Thus, there remains a need for improved oxidative or thermal stability of organopolysiloxane release agent fluids to minimize or eliminate the emission of volatile compounds, such as formaldehyde, at fuser operating temperatures. The need is preferably achieved without the use of an external additive package or without compromising or diminishing the release properties of the oil. Failure to satisfy the aforementioned need suggests that machine users will continue to be exposed to potentially hazardous or unpleasant odors due to degradative generation or evaporation of dissolved volatile compounds, such as formaldehyde, from release agent oil compositions comprised of polydiakylsilicone and derivative silicone oils at fuser roll operating temperatures.

SUMMARY OF THE INVENTION

It is a object of the present invention to provide improved processes for fusing a toner image on an image receiving substrate.

It is another object of the present invention to provide a novel release agent oil composition, enabling the application of this composition to a fusing surface and thereby producing and conferring desirable release characteristics to an image receiving substrate bearing a fused toner image.

It is a further object of the present invention to provide a fusing process using a silicone release agent oil formulation wherein the release agent exhibits excellent release property performance and minimizes or eliminates the generation and emission of volatile products arising from oil degradation.

Another object of the present invention is to provide a release agent oil blend composition comprised of at least one mercapto functionalized silicone oil in a minor amount and at least one non-mercapto silicone oil in a major amount, for example, in excess of 50 percent.

Still another object of the present invention is to provide an economical solution to the problem of formaldehyde and related compound volatile emission generation and suppression from release agent compositions.

Still yet another object of the present invention is to provide a release agent composition which solves the problem of formaldehyde volatile emission generation and suppression and without adversely affecting the physical properties and performance characteristics of the release agent composition or the fuser roller and related hardware.

These and other objects of the present invention can be accomplished by the provision of fuser members and processes for fusing toner images to a receiving substrate comprising: providing a fusing member having a fusing surface; heating the fuser member to an elevated temperature to fuse the toner to the substrate; applying directly to said fusing surface a release agent oil blend composition wherein volatile emissions, such as formaldehyde, arising from in situ degradation of the fuser release agent oil composition at fusing temperatures are significantly curtailed or eliminated. Fuser release agent oil blends useful in the present invention, in embodiments, include blends comprised of at least one mercapto functional silicone oil and at least one non-mercapto silicone oil selected from the group consisting of an amino functional siloxane, phenyl methyl functional siloxane, trifluoroalkyl or aryl functional siloxane, and a non functional silicone oil.

Also, the present invention relates to fuser oil compositions comprising a blend of at least one mercapto functionalized silicone oil in minor amounts, for example, less than 30 percent, and at least one non-mercapto functionalized silicone oil selected from the group consisting of a non functional or polydialkyl substituted siloxane silicone oil and an amino functionalized silicone in a major amount, wherein hazardous levels of volatile emissions of formaldehyde are effectively controlled or eliminated at elevated or operating temperatures employed for intermediate and high speed roll or belt fusing applications.

The use of a release agent oil composition comprised of a blend of a mercapto functional silicone in minor amounts and a non-mercapto dimethyl silicone oil as the major component, for example, 70 to about 99.9 percent, provides an economical solution to the problem of formaldehyde volatile emission generation and suppression without compromising the release performance properties of the release agent oil.

The above objects are achieved in embodiments of the present invention without the use of additional non oil additives, such as known metal salt stabilizers, inhibitors, antioxidants, anticorrosives, and the like. Thus, an additional advantage of the present invention is the provision of a thermally and oxidatively stabilized release agent oil composition which contains only release agent oil and is uncompromised by non oil ingredients.

Other advantages associated with the present invention include the provision of release agent oil formulations which provide excellent. release properties of fused toner images from fuser rolls without being accompanied by release agent oil degradation and the aforementioned accompanying volatile emission complications.

BRIEF DESCRIPTION OF DRAWINGS

The FIGURE is a graphical representation of measured amounts volatile formaldehyde versus time or evolution rates of formaldehyde emitted from individual release agent oils and blends thereof.

DETAILED DESCRIPTION OF THE INVENTION

In embodiments of the present invention, a release agent oil composition, for example, containing a mixture of a mercapto functionalized silicone oil compound in an effective amount, for example, from about 0.1 to about 30 percent by weight and a second non-mercapto functionalized oil, such as polydimethyl silicone oil in an effective amount of, for example, about 99.9 to about 70 percent by weight, which second polydimethyl silicone oil compounds can be selected from the group consisting of known non functional silicone oils including an amino functional siloxane, phenyl methyl siloxane, trifluoropropyl functional siloxane, and a non functional silicone oil or polydimethylsiloxane oil, is effective in volatile emission control or suppression of, for example, formaldehyde at elevated or operating temperatures from the fuser oil blend composition. The release agent oil composition and fusing method employing said composition limits the level of formaldehyde volatile emission arising from oxidative and thermal degradative processes to less than about 1.0 to 10 micrograms formaldehyde per gram of oil blend (or parts per million) per hour at temperatures around 200° C. The release agent formulations which did not contain the mercapto functional silicone had significantly higher levels of formaldehyde emission, reference the Figure and the working Examples.

Thus, in embodiments of the present invention, are provided a process for fusing toner images to a receiving substrate comprising: providing a fusing member having a fusing surface; heating the fuser member to an elevated temperature to fuse the toner to the substrate; applying directly to the fusing surface a fuser release agent oil blend composition and wherein volatile emissions arising from the fuser release agent oil blend are minimized or eliminated. Although not wanting to be limited by theory, the release agent oil blends of the present invention are believed to be effective in suppressing the formation and therefore the evolution of formaldehyde degradation products from heated fuser oil blend because the mercapto functionalized silicone oil is capable of acting as a potent oxidation and free radical inhibitor or free radical trapping agent. Even at relatively low levels, for example, from about 0.1 to 5 weight percent, the mercapto functionalized silicone oil compounds reduced formaldehyde formation and measurable emission of formaldehyde from a fuser release agent oil composition containing 95 percent by weight or more of an amino functionalized silicone or a non-functionalized silicone to less than about 10 ppm/hour compared to several hundred ppm/hour for oil formulations which did not contain the mercapto functionalized silicone oil. For this reason, and as suggested and supported by measured amounts and evolution rates of formaldehyde emitted from individual release agent oils and blends thereof as illustrated graphically in the aforementioned Figure representing formaldehyde evolution versus time, it is believed that the mercapto functionalized silicone oil component is acting as a potent oxidation or thermolysis inhibitor as in, for example, known free radical scavenging mercapto compounds, or in an alternative less understood way, acting in synergy with the non-mercapto silicone oil component to form a more thermally and or oxidatively stable release agent oil composition.

The silicone oil compounds of the present invention, in embodiments, reference for example the aforementioned and illustrated compounds, can be easily prepared or are available and are disclosed in for example U.S. Pat. Nos. 4,251,277 and 4,845,003 the disclosures of which are totally incorporated herein by reference and for example, by the reaction of, for example, dialkyldialkoxysilanes and various functional derivatives thereof. In embodiments of the present invention, a suitable mercapto functional silicone has a structural formula (I) wherein R is an alkyl group (I)

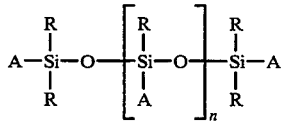

having from 1 to about 18 carbon atoms or an aryl group having from 6 to about 18 carbon atoms, at least one A is a mercaptopropyl ($HS—CH_2 CH_2 CH_2—$) or mercaptoalkyl group having from 1 to about 18 carbon atoms, and n is a number from about 10 to about 200.

Suitable and representative amino functional siloxane and non functional silicone release agent oils useful in the present invention have general structural formulas (II) and (III), respectively, wherein in the first (II)

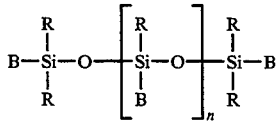

instance of the amino compound (II) the R is an alkyl group having from 1 to about 18 carbon atoms or an aryl group having from 6 to about 24 carbon atoms, at least one B is an aminoalkyl group having from 1 to 10 carbon atoms, and n is a number from about 10 to about 200, and in the second instance of the non-functional compound (III) the R is an alkyl group having from 1 to about 18 carbon atoms, such as methyl, ethyl, propyl, butyl, and the like, or an aryl group having from 6 to about 18

(III)

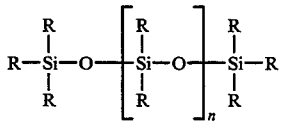

carbon atoms, such as phenyl, benzyl napthyl, and the like, and n is a number from about 10 to about 200. One preferred amino alkyl derivative compound (II) is aminopropyl or aminoisopropyl. Trifluoroalkyl or trifluoroalkyaryl functional silicone oils useful in embodiments of the present invention have a structural formula (IV) wherein R is an alkyl (IV)

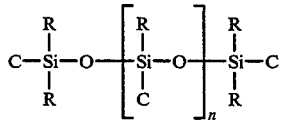

group having from 1 to about 18 carbon atoms or is an alkylaryl group having from 7 to about 24 carbon atoms, C is at least one trifluoroalkyl or trifluoroalkylaryl group with from 1 to about 18 carbon atoms, and n is a number from about 10 to about 200. Phenyl methyl siloxane and trifluoropropyl functional siloxane oils are available, for example, from Hüls America, Inc.

Release agent oil compounds useful in the present invention, for example, may be optionally devolatilized by known methods employing heating under vacuum to remove other potentially volatile components, preferably at the site of manufacture, prior to use in a fuser oil release agent application.

Preferred release agent oil compositions useful in the present invention have a low level of volatile emissions at ambient or at elevated fuser operational temperatures, for example in embodiments, volatile formaldehyde emissions of less than about 1.0 to 50.0 parts per million per hour over a temperature range 120° C. to about 260° C.

The viscosities of the release agent oils of the present invention are believed to be important to the proper functioning of the release agent oils to provide efficient and reliable release of receiver sheets bearing fused images from the fuser member. Preferred ranges of viscosity of release agent oils follow: mercapto or thiol (H—S—) functional silicone release agent oils have a kinematic viscosity in the range of about 200 to about 300 centistokes, the amino functional silicone oils have a kinematic viscosity in the range of about 250 to about 350 centistokes, and the non functional silicone oils have a kinematic viscosity in the range of about 100 to about 13,000 centistokes.

Release agent oil blends useful in the present invention have individual weight average molecular weights from about 6,000 to about 70,000.

The release agent oil compositions of the present invention may be applied to the fusing surface of the fuser roll by known methodology such as a roller applicator or by wicking action. The amount of the release agent oil applied to the roll and subsequently transferred to the receiver sheet is in the range from about 1 to about 6 microliters per sheet and preferably from about 1 to about 3 microliters per sheet for best release and most efficient use of the oil composition.

Fuser rolls useful in the present invention are comprised of a rigid or slightly flexible substrate or support and coated thereover with an optional coating material having suitable thermal and durability properties to withstand the rigors of thermal and pressure fusing processes. The surface fusing layer may be constructed of known materials such as silicone elastomers, fluoroelastomers, fluorosilicone elastomers, various hybrid elastomeric or ceramic materials, and the like. Preferred fuser roll coating compositions of the present invention are those materials that are chemically and thermally inert to the conditions of thermal and pressure fusing. These materials are selected from compositions wherein the toner resins or toner performance additive ingredients have a very low tendency to stick to, adhere to, or react with, the roll coating or roll substrate. The aforementioned preferred fuser roll coating compositions are in embodiments VITONS®, such as VITON GF, optionally filled with copper oxide, iron oxide or lead oxide, or dimethyl silicone rubbers, such as RTV rubbers, filled with, for example, iron oxide or alumina.

Toners useful in the present invention are comprised of resin particles, pigment particles, optional charge additives, optional surface additives, and the like, in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a black or colored pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene n-butyl methacrylate copolymer (58/42), 6 percent by weight of REGAL 330® carbon black, and 2 percent by weight of the charge enhancing additive cetyl pyridinium chloride. The aforementioned toners may include as surface or external components additives in an effective amount of, for example, from about 0.1 to about 3 weight percent, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, metal oxides, and the like, for the primary purpose of controlling toner conductivity and powder flowability.

Suitable toner resins can be comprised of known polymers such as those illustrated in the U.S. patents mentioned herein, such as styrene acrylates, styrene methacrylates, crosslinked styrene acrylates, styrene methacrylates, wherein the crosslinking component can, for example, be a divinylbenzene; and more specifically styrene butylmethacrylate (58/42), polyesters, linear and branched such as SPAR polyesters, crosslinked polyesters, and the like. Also, known suspension polymerized styrene butadienes and emulsion polymerized styrene butadienes may be selected as the toner resin.

Carriers that may be selected to form the developers include those comprised of cores of steel, ferrites, such as copper zinc ferrites, other known ferrites, iron, sponge iron, and the like. The carrier cores may be coated with an effective amount of polymers, either with a continuous or semicontinuous coating, wherein the coating weight in embodiments is from about 0.1 to about 3 weight percent. Examples of coatings include fluoropolymers, such as KYNAR® terpolymers of styrene, methacrylate and an organosilane, chlorotrifluoroethylene-vinyl chloride copolymers, chlorotrifluoroethylene-vinylacetate copolymers, polymethacrylate, and the like. Also, there may be selected the carriers of U.S. Pat. Nos. 4,937,166 and 4,935,326, the disclosures of which are totally incorporated herein by reference. Developers are prepared by mixing from about 0.5 to about 5 weight percent toner and about 95 to about 99.5 percent by weight of carrier particles.

The photoresponsive imaging member can be negatively charged, positively charged, or both, and the latent image formed on the surface may be comprised of either a positive or a negative potential, or both. Similar imaging processes are envisioned for the toners and developers of the present invention.

The developed image can then be transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to known substrates by a known thermal and or pressure fusing member as disclosed herein. For the present invention, fusing by application of heat and pressure along with the application of a release agent oil is preferred.

One preferred mecaptopropyl silicone fluid useful in the present invention is SILICONE FLUID F-1076 available from S.W.S. Silicones Corp., and has the following properties: mercaptan content: % SH by weight 0.09; viscosity bulk kinematic at 25° C.: 225–300 cST; volatility (at 200° C./24 hours, percent weight loss): 0.60; and hydrogen sulfide(odor): <25 ppm by potentiometric titration, head space analysis, and color reaction with reagent.

One preferred amino silicone fluid useful in the present invention and is available as FUSER SHIELD from Wacker Silicones, and has the following properties: viscosity bulk kinematic at 25° C.: 265–335 cST; volatility (percent volatiles as calculated above): 0.70; and an amine number, (meq/g) acid titration with potentiometric end point: 0.006–0.014.

One preferred non functional silicone fluid useful in the present invention and is available as DOW CORNING 200 Fluid from Dow Corning Corporation, and has the following properties: viscosity bulk kinematic at 25° C.: 100 cST; and volatility (percent volatiles as calculated above): 0.65. The volatility of the aforementioned samples may be calculated as follows: % Volatiles=$[W_2-W_3/W_2-W_1\times 100$ where W1 is the tare weight; $W_2$ is the sample+tare weight; and $W_3$ is the sample+tare weight after heating in a forced air convection oven and cooling.

Specific embodiments of the invention will now be described in detail. These examples are intended to be illustrative, and the invention is not limited to the materials, conditions, or process parameters set forth in these embodiments. All parts and percentages are by weight unless otherwise indicated. Comparative Examples are also provided.

The following working Examples illustrate how the level of formaldehyde emission was measured for mixtures of release agent oils and blends of the present invention and selected Comparative Examples. The results are indicated graphically in the aforementioned Figure.

PROCEDURE USED TO MEASURE FORMALDEHYDE EMISSION FROM HEATED RELEASE AGENT OIL SAMPLES

A 0.50 gram sample of the selected silicone oil was heated in a midget impinger at 400° F., with an air purge rate of about 44 mL per minute. The evolved formaldehyde was passed through a second impinger that contained 15 mL of 0.1N sodium hydroxide. After the predetermined heating time, the impinger was removed and replaced with another impinger containing 15 mL of 0.1N NaOH. This process was repeated until a steady state of formaldehyde evolution was reached or a maximum of 300 minutes had elapsed. The sodium hydroxide solutions were analyzed by differential pulse polarography at a half wave potential of about −1.75 volts (vs Ag/AgCl reference electrode) to determine the levels of formaldehyde emitted.

EXAMPLE I

FORMALDEHYDE EMISSION FROM MERCAPTO SILICONE:AMINO SILICONE (20:80 MIXTURE)

The release agent oil used was a mixture of 20 parts by weight of the aforementioned SILICONE FLUID F-1076, a mercaptan functional polydimethylsiloxane fluid available from Wacker Silicones Corporation and 80 parts by weight of the aforementioned FUSER SHIELD amino functional silicone fluid. The blend was prepared by simple mixing of the oils at ambient temperature for about two to three hours. The mixture was heated to 400° F. and the formaldehyde emission was measured with respect to time. The formaldehyde emission for this mixture was less than 4 ppm over 250 minutes, which is nearly below the detection limit of the polarographic method used to monitor the formaldehyde emitted from the heated oil mixture. The formaldehyde evolution curve or emission profile for this mixture corresponds to line 40 in the Figure.

EXAMPLE II

FORMALDEHYDE EMISSION MERCAPTO SILICONE:AMINO SILICONE (2.9:97.1 Weight Ratio)

The procedure used in Example I was repeated with the exception that the release agent oil used was a simple mixture of 2.9 parts by weight of the aforementioned SILICONE FLUID F-1076, and 97.1 parts by weight of the aforementioned FUSER SHIELD, aminopropyl functional silicone. The formaldehyde emission for this mixture was less than about 110 ppm over 250 minutes. The evolution curve or emission profile for this mixture corresponds to as line 30 in the Figure.

EXAMPLE III

FORMALDEHYDE EMISSION MERCAPTO SILICONE:NONFUNCTIONAL SILICONE (2.9:97.1 Weight Ratio)

The procedure used in Example I is repeated with the exception that the release agent oil used is a simple mixture of 2.9 parts by weight of the aforementioned SILICONE FLUID F-1076, and 97.1 parts by weight of the aforementioned non functional polydimethylsilicone fluid DOW CORNING 200 Fluid. The formaldehyde emission for this mixture is less than about 100 ppm over 250 hours. The evolution curve or emission profile for this mixture is expected to less than or equal to line 30 shown in the Figure.

Comparative Example I

AMINO SILICONE

The procedure used in Example I was repeated with the exception that the release agent oil used was exclusively the aforementioned amino functional silicone oil FUSER SHIELD. The formaldehyde emission for this release agent fluid was about 574 ppm over about 175 minutes, indicative of an unacceptable emission level. The formaldehyde evolution curve or emission profile for this amino functional fluid is shown in the Figure and corresponds to line 10.

Comparative Example II

NONFUNCTIONAL SILICONE

The procedure used in Example I was repeated with the exception that the release agent oil used was exclusively the aforementioned DOW CORNING non-functional polydimethylsiloxane silicone oil. The formaldehyde emission for this oil was about 330 ppm over 300 minutes, indicative of an unacceptable emission level. The formaldehyde evolution curve or emission profile for this release agent is shown in the Figure and corresponds to line 20.

Comparative Example II

MERCAPTO SILICONE

The procedure used in Example I was repeated with the exception that the release agent oil used was exclusively the aforementioned mercapto functional silicone oil SILICONE FLUID F-1076. The formaldehyde emission for this release agent was about 4 ppm over 250 minutes, indicative of an excellent and low emission level. The evolution curve or emission profile for this oil is shown in the Figure and corresponds to the aforementioned line 40. Although the emission profile for this oil alone is excellent, the higher cost and higher viscosity of using exclusively this mercapto oil are disadvantages.

The disclosures of the above mentioned patents and publications are incorporated herein by reference in their entirety.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for fusing toner images to a substrate comprising:

providing a fusing member having a fusing surface;

heating said fuser member to an elevated temperature to fuse toner to said substrate;

applying directly to said fusing surface a fuser release agent oil blend composition wherein volatile emissions arising from the fuser release agent oil blend are minimized or eliminated.

2. A process in accordance with claim 1 wherein said release agent oil blend composition is comprised of at least one mercapto functional silicone and at least one non-mercapto silicone oil.

3. A process in accordance with claim 2 wherein the non-mercapto silicone oil is selected from the group consisting of an amino functional oil, a phenyl methyl functional oil, a trifluoroalkyl functional oil, a trifluoroalkylaryl functional oil, and a non functional dialkyl silicone oil.

4. A process in accordance with claim 1 wherein said volatile emissions arise from degradation of the fuser release agent oil blend at elevated temperatures in the presence of oxygen.

5. A process in accordance with claim 1 wherein said volatile emissions arise from thermal or oxidative degradation of the fuser release agent oil blend.

6. A process in accordance with claim 4 wherein said volatile emissions arising from degradation of said fuser release agent oil blends are formaldehyde.

7. A process in accordance with claim 1 wherein said fusing surface is selected from the group consisting of a silicone elastomer, a fluorosilicone elastomer, a fluorinated hydrocarbon polymer, a fluorinated hydrocarbon and silicone polymer blend, silicone copolymers, and crosslinked blends of fluorinated hydrocarbon copolymers and silicone copolymers.

8. A process in accordance with claim 1 wherein said direct application to said fusing surface of a release agent oil blend composition is accomplished with a wick or an applicator roller.

9. A process in accordance with claim 2 wherein the mercapto functional silicone oil is present in an amount from about 1 to about 20 percent by weight of the oil blend.

10. A process in accordance with claim 2 wherein said mercapto functional silicone has a structural formula (I) wherein R is an

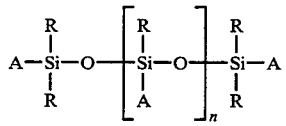

(I)

alkyl group having from 1 to about 18 carbon atoms or an aryl group having from 6 to about 24 carbon atoms, A is at least one mercaptoalkyl group with from 1 to about 18 carbon atoms, and n is a number from about 10 to about 200.

11. A process in accordance with claim 2 wherein said mercapto functional silicone has a kinematic viscosity of about 200 to about 300 centistokes.

12. A process in accordance with claim 3 wherein the amino functional siloxane, a phenyl methyl functional oil, a trifluoroalkyl functional oil, a trifluoroalkylaryl functional oil, or non functional silicone oil is present in an amount from about 99.9 to about 70 percent by weight of the oil blend.

13. A process in accordance with claim 3 wherein said aminoalkyl or aryl functional silicone has a structural formula (II) wherein

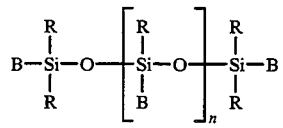

(II)

R is an alkyl group having from 1 to about 18 carbon atoms or an aryl group having from 6 to about 24 carbon atoms, B is at least one aminoalkyl or aryl group with from 1 to about 18 carbon atoms, and n is a number from about 10 to about 200.

14. A process in accordance with claim 3 wherein said amino functional silicone has a kinematic viscosity of about 250 to about 350 centistokes.

15. A process in accordance with claim 3 wherein said non functional and phenyl methyl functional silicone oils have a structural formula (III) wherein R is an alkyl group having from 1 to about 18 carbon

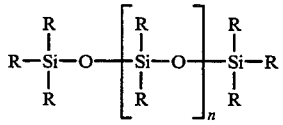

(III)

atoms or an aryl group having from 6 to about 24 carbon atoms, and n is a number from about 10 to about 200.

16. A process in accordance with claim 3 wherein said non functional and phenyl methyl functional silicone oils have silicone oil have a kinematic viscosity of about 100 to about 13,000 centistokes.

17. A process in accordance with claim 3 wherein each oil of said release agent oil blend has a weight average molecular weight of about 6,000 to about 70,000.

18. A process in accordance with claim 1 wherein said fusing member is thermally conductive and comprises a rigid substrate coated with a thin layer of a silicone elastomer.

19. A process in accordance with claim 18 wherein said silicone elastomer is a cross-linked dimethyl silicone rubber, optionally filled with up to 37 weight percent iron oxide, 70 weight percent alumina, from about 2 to about 50 percent weight copper oxide or lead oxide, or up to 34 weight percent silicon dioxide particles.

20. A process in accordance with claim 18 wherein said fuser member has a rigid substrate that is a metallic roll, belt or web.

21. A process in accordance with claim 20 wherein said metallic roll, belt or web is aluminum and wherein said thin layer of silicone elastomer is about 0.002 inch to about 0.5 inch thick.

22. A process in accordance with claim 1 wherein the release agent oil composition is optionally devolatilized prior to use in the fusing process.

23. A process in accordance with claim 1 wherein said volatile emissions from said fuser oil blend composition are comprised of formaldehyde and are released in an amount of less than about 2.0 to 100.0 parts per million per hour at about 200° C. (400° F.).

24. A process in accordance with claim 1 wherein said elevated temperature to said toner to said substrate is from about 120° C. to about 260° C. for about 1 millisecond to about 60 seconds.

* * * * *